United States Patent [19]

Bargiel et al.

[11] Patent Number: 4,525,888

[45] Date of Patent: Jul. 2, 1985

[54] MAINTAINING CONSTANT PICK-UP BROOM PATTERN

[75] Inventors: Douglas A. Bargiel, Grand Terrace; Edward M. Assony, Westminster; Truong M. Ha, Riverside; Richard B. Rosseau, Clairmont, all of Calif.

[73] Assignee: FMC Corporation, Chicago, Ill.

[21] Appl. No.: 530,832

[22] Filed: Sep. 9, 1983

[51] Int. Cl.[3] ..... E01H 1/04

[52] U.S. Cl. ..... 15/83

[58] Field of Search ..... 15/82–87, 15/340

[56] References Cited

U.S. PATENT DOCUMENTS 2,637,055 5/1953 Mott ..... 15/83

3,825,968 7/1974 Larsen ..... 15/87

*Primary Examiner*—Edward L. Roberts

*Attorney, Agent, or Firm*—A. J. Moore; H. M. Stanley; R. B. Megley

[57] ABSTRACT

An overcenter, spring loaded linkage is disclosed for applying a lifting force to a pick-up broom of a street sweeper when the broom is new and heavy, and for applying a downward pressure on the broom when the broom is worn and light in weight. The linkage maintains a substantially constant pick-up broom pattern on the surface being swept throughout the useful life of the broom in spite of a substantial reduction in broom diameter due to wear.

8 Claims, 5 Drawing Figures

12
2
14
51
54
56
52
50
10
32
58
28
24
26
30
16
20
62
60
22
36
34
64
38
66
72
68
48
76
70
40
44
2

12
14
51
54
52
18
50
10
32
4
4
24
26
28
A
16
30
58
22
62
60
36
34
38
40
48
20
72
64
68
66
76
70
44

MAINTAINING CONSTANT PICK-UP BROOM PATTERN

CROSS REFERENCE TO RELATED APPLICATIONS

The present invention is useable with the apparatus disclosed in the following applications, which applications are assigned to the assignee of the present invention:

Erdman et al Application Ser. No. 431,948 which was filed on Sept. 30, 1982 entitled Multiple Flight Elevator now U.S. Pat. No. 4,457,004 which issued on July 3, 1984.

Kassai Application Ser. No. 431,947 which was filed on Sept. 30, 1982 entitled Sweeper With Hydraulically Driven Components.

The above applications are incorporated by reference herein.

BACKGROUND OF THE INVENTION

1. Field of the Invention

The present invention relates to street sweepers or the like and more specifically relates to apparatus for maintaining a substantially constant pressure and pick-up broom pattern on a surface being swept for the useful life of the broom, which broom varies in size, weight and stiffness during its life due to wear.

2. Description of the Prior Art

Street sweepers and controls for operating the same are known and disclosed in the above referred to applications. The sweeper includes a main or pick-up broom which engages streets or the like to be swept. In the Kassai application a hydraulic cylinder is disclosed for raising and lowering the sides of the pick-up broom, and a pressure gauge located in the cab is connected to the cylinder thereby enabling the operator to maintain a light, medium, or heavy pick-up broom pressure on the surface being swept.

In the above type of sweeper, whether a three wheel or a four wheel sweeper, it is desirable to maintain a substantially constant pick-up broom sweeping pressure and pattern against the surface being swept during the life of the broom. It is well known that a new pick-up broom of about 36 inches in diameter is heavy and thus requires a lifting force acting thereon to provide the desired sweeping pressure and pattern. When the pick-up broom is worn to its minimum acceptable diameter of about 16 inches, the broom is much lighter and requires a downward force to provide the desired sweeping pattern. The pick-up broom is journaled on the ends of a pair of laterally spaced arms that are provided to the chassis of the sweeper and is pivotally moved between a raised transport position and a lowered working position against the surface to be cleaned by a hydraulic cylinder.

SUMMARY OF THE INVENTION

In accordance with the present invention a spring actuated pressure controlling mechanism is connected between the chassis and lift arms on one side of the pick-up broom to control the downward pressure on both sides of the broom to provide the desired resulting downward sweeping pressure and pattern of the pick-up broom. The pressure controlling mechanism is of the overcenter linkage type, with the axis of the spring moving from one side to the other side of the axis of a transverse pivot shaft journaled on the chassis. In the illustrated preferred embodiment, a spring tensioning adjustment bolt connects one end of the spring to the chassis, and a pivotally mounted spring positioning lever and anchoring bolt connects the other end of the spring to the transverse shaft to adjust the spring upwardly or downwardly relative to the transverse pivot shaft. It will be understood, however, that it is within the scope of the invention to eliminate the adjustment features of the spring positioning lever by pivotally mounting the end of each spring in a fixed position on the anchoring lever.

Prior to describing the invention in detail, it will be understood that the weight of the broom, which varies due to wear during its useful life, is the dominant force acting on the broom and will urge the broom against the surface to be swept at all times during the sweeping operation. However, the weight of a new broom provides a broom pattern that is too wide, and therefore the spring actuated pressure controlling mechanism provides a progressively decreasing lifting force to the broom until the weight of the broom alone is sufficient to provide the desired broom pattern. Further broom wear causes the overcenter linkage mechanism to move overcenter and apply a gradually increasing downward force, aided by the gradually reducing weight of the broom, to maintain the desired broom pattern for the remainder of the useful life of the broom.

DESCRIPTION OF THE PREFERRED EMBODIMENT

The pick-up broom pressure control mechanism 10 (FIGS. 1–5) of the present invention is mounted on the chassis 12 of a street sweeper of the general type referred to in above mentioned patent applications. The street sweeper includes a pick-up broom 14 that is journaled on one end of a spaced pair of arms 16 that are journaled on the vehicle chassis 12. The pick-up broom is driven by a hydraulic motor (not shown).

Figure 3:
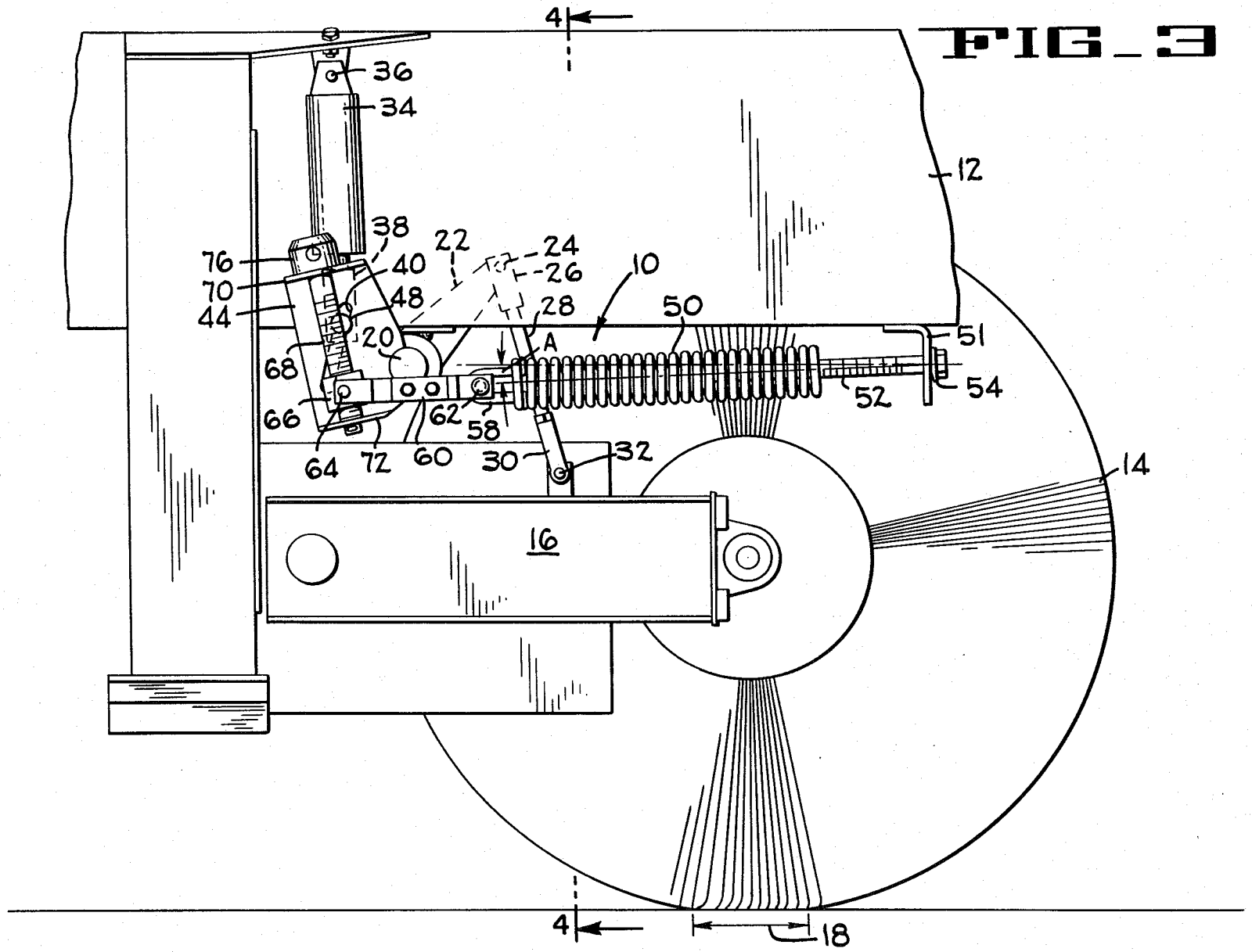
FIG. 3 is a side elevation of the mechanism of FIG. 2 with the mechanism in position to exert a lifting force on a new full size broom in sweeping position on the street and illustrating the desired broom pattern.
Figure 5:
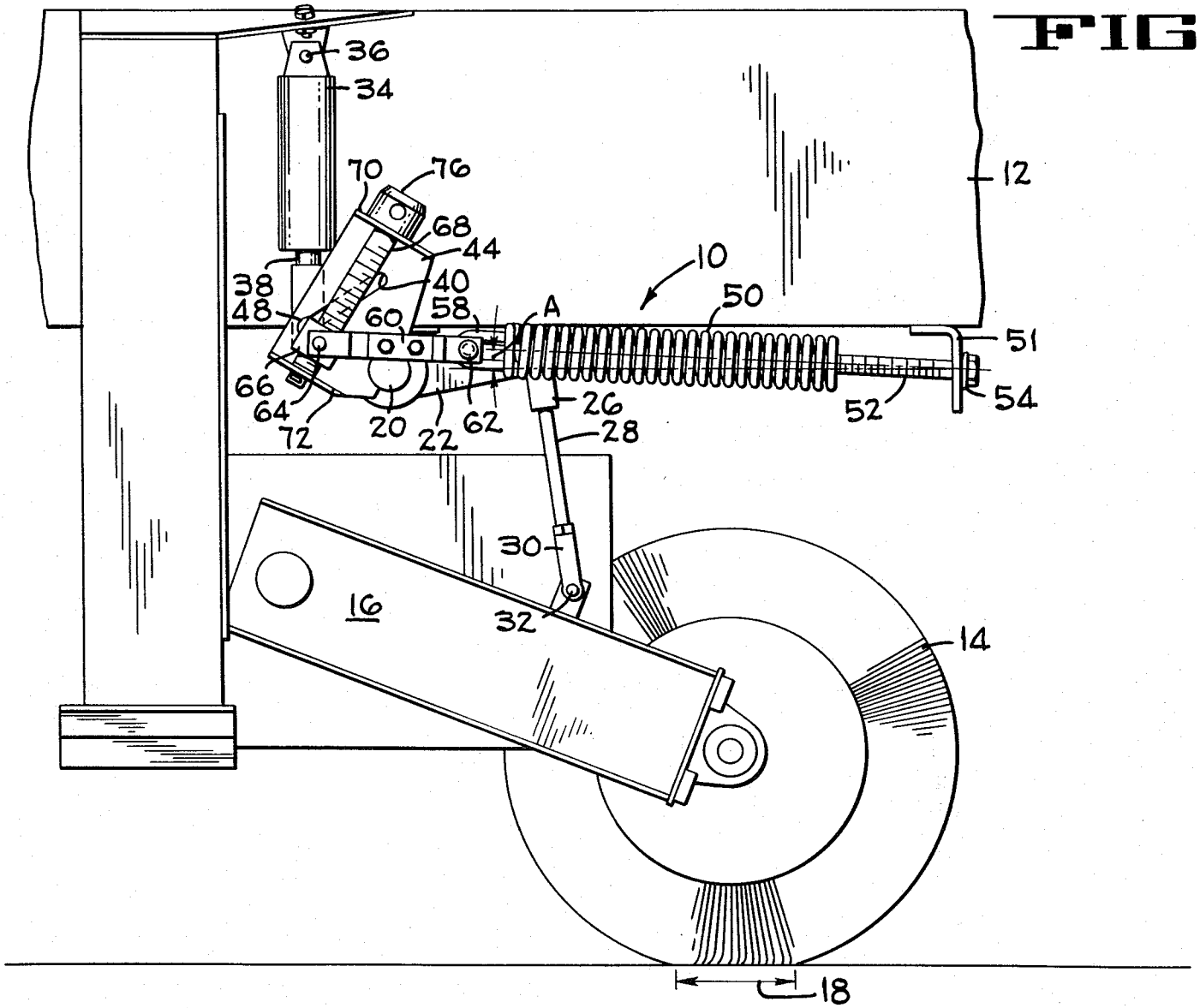
FIG. 5 is a side elevation similar to FIG. 3 but illustrating a broom worn to the end of its useful life engaging the street with the same broom pattern.

The pressure control mechanism 10 functions to control the working pressure of the broom 14 against a street or the like being cleaned to provide a broom pattern or "strike" 18 (FIGS. 3 and 5) on the street that is about 6 to 8 inches wide transversely of the broom when the broom size varies between about 36 to 16 inches in diameter during its useful life. As illustrated in FIGS. 3 and 5, the lower portion of the broom 14 is substantially flat in the "strike".

The pressure control mechanism 10 comprises an elongated transversely extending shaft 20 (FIG. 4) journaled on the chassis and extending from one side to the other side of the pick-up broom 14 at a location above and forwardly of the broom. A pair of levers 22 are keyed to the shaft 20 and are pivotally connected by pins 24 to yokes 26 welded to connecting rods 28 having their lower ends threaded. Yokes 30 and cooperating locknuts are screwed on the lower ends of the rods 28 and are pivotally connected to associated ones of the arms 16 by pins 32 as clearly illustrated in FIG. 2.

Figure 4:
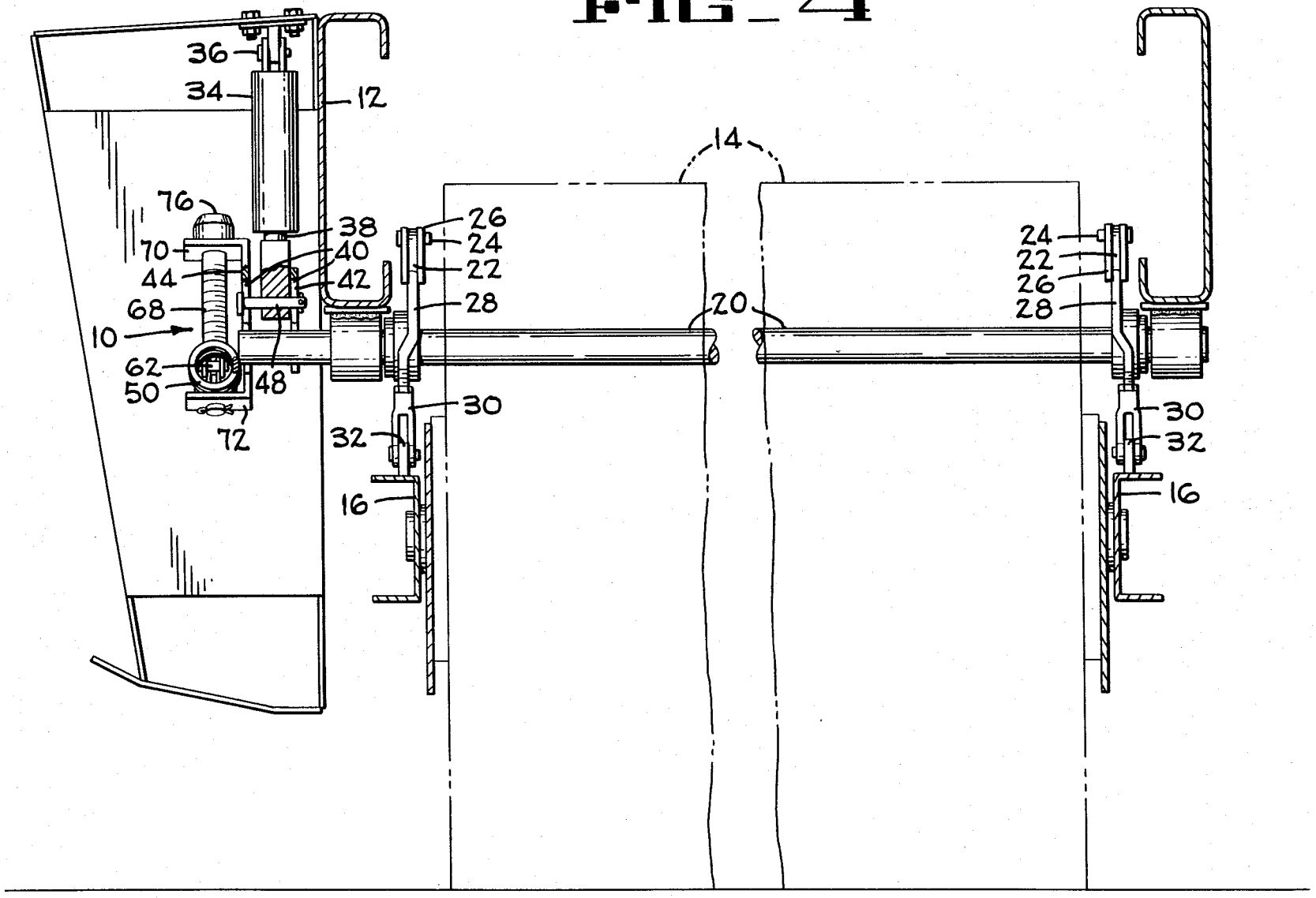
FIG. 4 is a section taken along lines 4—4 of FIG. 3.

In order to lift the pick-up broom 14 from its sweeping position to a transport position above the ground, a hydraulic lift cylinder 34 is pivotally secured to a portion of the chassis 12 by a pivot pin 36. The piston rod 38 of cylinder 34 is connected to parallel elongated slots 40 (FIGS. 3, 4 and 5) in levers 42,44, both of which are welded to the shaft 20. The lever 44 is channel shaped as best shown in FIG. 4. A pin 48 completes the pivotal connection of the piston rod to the shaft 20.

As illustrated in FIG. 3, the piston rod 38 is fully retracted, and a full diameter pick-up broom shown in solid lines is resting upon the street to be swept providing a "strike" of about 6 to 8 inches in width. At this time the pin 48 is near the top of the slots 40. Accordingly, as broom wear occurs, the shaft 20 and levers 42,44 will pivot in a clockwise direction (FIG. 3) permitting the slots 40 to freely move upwardly relative to the pin 48 until the pick-up broom has been worn to its minimum acceptable diameter as indicated in FIG. 5 at which time the pin 48 will be at or near the bottom of the slots 40. When it is desired to lift the pick-up broom to its transport position illustrated in FIG. 1, the operator merely actuates a conventional hydraulic control lever (not shown) thereby directing hydraulic fluid into the cylinder 34, urging the piston rod 38 and pivot pin 48 downwardly. The pin 48 engages the lower end of the slots 40 which pivots the shaft 20 in a counterclockwise direction thereby lifting the connecting rods 28, arms 16 and pick-up broom 14, whether new or worn, into the transport position of FIG. 1.

An important feature of the invention is the use of the spring actuated pressure control mechanism 10 to control the downward pressure on both sides of the pick-up broom to provide a substantially constant broom pattern or "strike" against the surface being swept. The mechanism 10 compensates for broom wear during the life of the broom and maintains the broom pattern substantially constant during the broom life. As mentioned previously, in the preferred embodiment the broom diameter varies between about 36 inches to 16 inches in diameter during its useful life.

Figure 2:
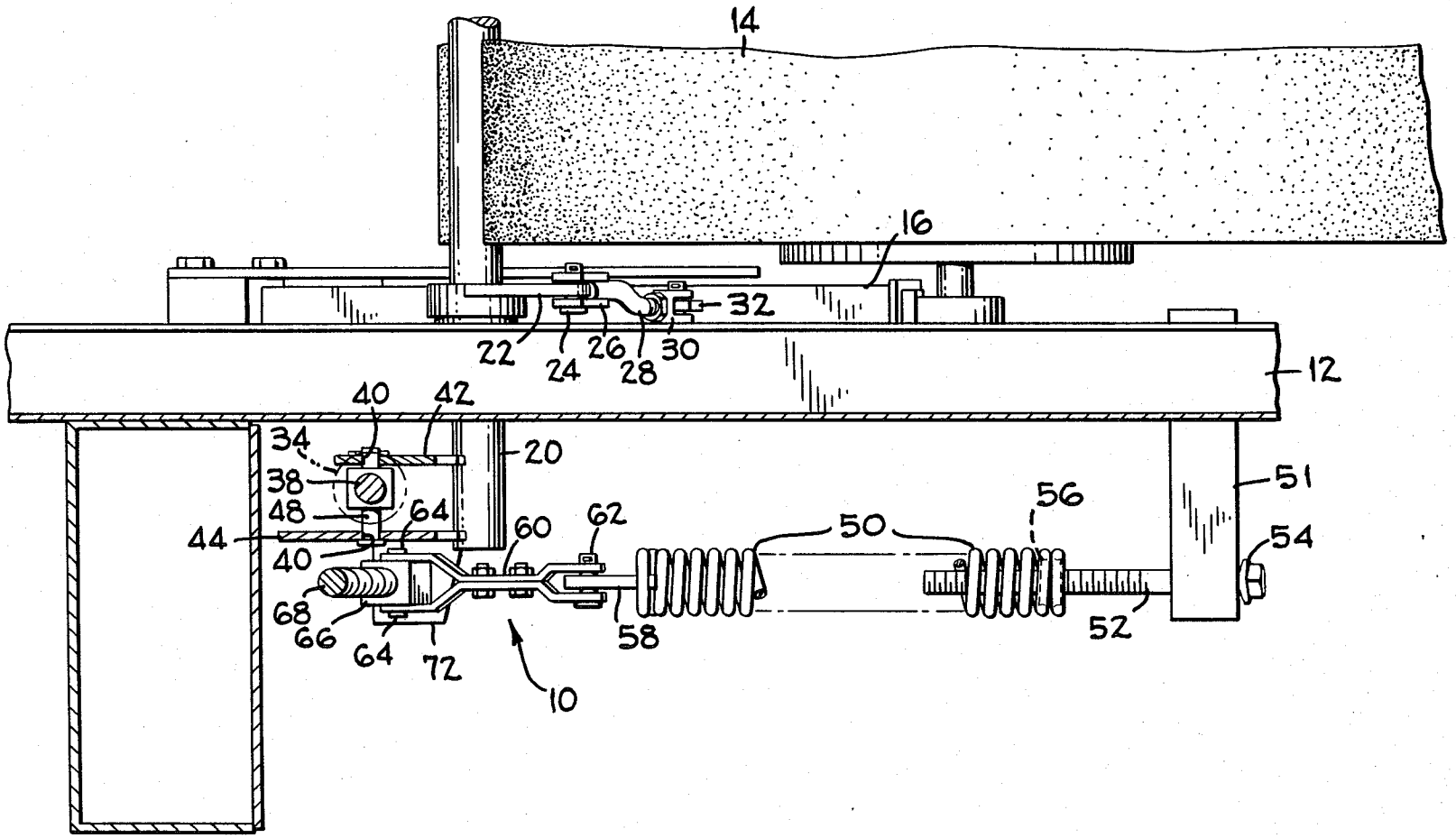
FIG. 2 is a horizontal section taken along lines 2—2 of FIG. 1 of said pressure controlling mechanism, the chassis and broom being shown in plan.

The control mechanism 10 (FIGS. 2, 3 and 4) includes a tension spring 50 having one end connected to a bracket 51 welded to the chassis 12. A tension adjustment bolt 52 extending through an aperture in the bracket 51, and a concave washer 54 engages the bracket permitting easy pivotal movement of the longitudinal axis of the spring relative to the bracket. The bolt 52 is threaded into a connector 56 screwed into the adjacent end of the spring 50. A similar connector with a yoke 58 projecting therefrom is secured to the other end of a spring 50. One end of a link 60 is pivotally connected to the yoke 58 by a pin 62, and the other end of the link is pivotally connected to circular ears 64 (FIG. 2) that are secured to and project outwardly from a square nut 66. The two halves of the link 60 may be bolted together as best shown in FIG. 2.

The nut 66 is threaded onto a spring positioning bolt 68 which extends through holes in upper and lower flanges 70,72, respectively, of the channel shaped lever 44, and is held from axial movement therein by a pin at its lower end, and by an apertured head 76 at its upper end. It is apparent that rotation of the spring positioning bolt 68 in one direction will raise the nut 66 relative to the lower flange 72, and that rotation of the bolt in the opposite direction will lower the nut. Thus, the operator or a mechanic may manually raise or lower the nut 66 by turning the bolt 68 in the proper direction in order to change the angle A (FIGS. 3 and 5) between the longitudinal axis of the spring 50 and a line interconnecting the axis of the shaft 20 and the center of the washer 54. It is also apparent that the tension of the spring 50 may be varied by rotating the bolt 68 in the proper direction.

In operation, the approximate weight of the new (heavy) pick-up broom of about 36 inch diameter, and the approximate weight of a light pick-up broom having no remaining useful life due to wear to about 16 inches in diameter is first determined. The sweeper operator or a mechanic then adjusts both the tension bolt 52 and the spring positioning bolt 68 to apply a sufficient upward lifting force against the broom when new or partially worn, and to apply a sufficient downward force against the broom when considerably worn so that the desired broom pattern or "strike" of about 5–6 inches will be maintained throughout the useful life of the broom.

When the pick-up broom is placed in use sweeping a street or the like, the diameter and weight of the pick-up broom gradually reduces due to wear. As wear continues, it will be appreciated that the axis of spring 50 gradually pivots upwardly about the point of contact between the arcuate washer and the bracket 51. When the weight of the broom is reduced by wear to an extent where neither upward nor downward spring force is required, the axis of the spring 50 passes through the axis of the shaft 20. Continued broom wear causes the axis of the spring 50 to move above the axis of the shaft 20 thereby progressively increasing the downward spring force which pushes the pick-up broom against the surface being swept with sufficient force to maintain the desired 6–8 inch width pick-up broom pattern. The pick-up broom is, of course, replaced by a new broom after the broom has been worn to its minimum acceptable diameter.

During the above described operation starting with a new pick-up broom and ending with a worn out broom, the spring tensioning bolt 52 and the spring positioning bolt 68 usually need not be readjusted to maintain the substantially constant pick-up broom pattern. Thus, it is within the scope of this invention to pivotally connect the linkage 60 at a fixed position on the channel bracket 44, while relying only on the tension adjustment bolt 52 for adjusting the broom lifting and lowering forces. However, it is apparent that in the illustrated preferred embodiment, the bolts 68 and 52 may be easily adjusted at any time if it appears that the broom pattern requires adjustment. For example, if higher than usual sweeping pressure is desired for dislodging dried mud or the like, the proper adjustments may be made.

Figure 1:
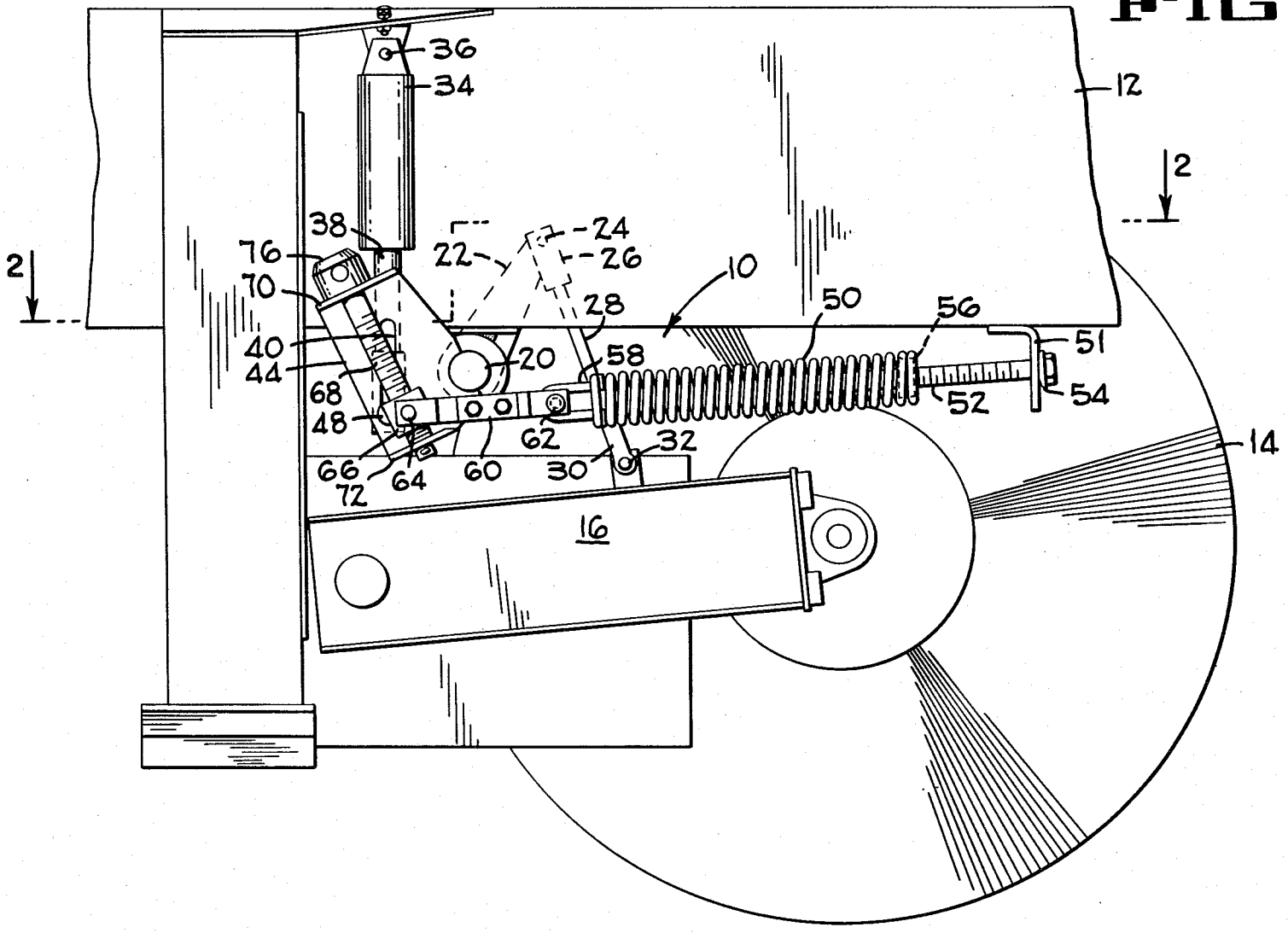
FIG. 1 is an elevation of a new pick-up broom pivotally connected to a chassis of a sweeper and illustrating the spring actuated pressure controlling mechanism of the present invention, said broom being in its transport position.

When it is desired to raise the pick-up broom to its transport position as shown in FIG. 1, the operator merely actuates conventional hydraulic controls for extending the piston rod 38 of the hydraulic cylinder 34. The pivot pin 48 then freely moves downwardly in the slots 40 until it contacts the lower end of the slot. Further downward movement of the piston then pivots the levers 42,44, the shaft 20, and the levers 22 in a counterclockwise direction thereby causing the linkages 28 and arm 16 to lift the pick-up broom 14 to the transport position which is at least about 1½ inches above the street.

If a more detailed description of a street sweeper and the controls to operate the same is desired, reference may be had to the aforementioned copending applications.

From the foregoing description it is apparent that the pick-up broom pressure control mechanism of the present invention includes a spring loaded overcenter linkage which applies a broom lifting force when the broom is new and heavy, and applies a force which pushes the broom against the surface being swept when the broom is worn and is light in weight. The mechanism also includes a lost motion hydraulically operated system for raising the boom to transport position without interfering with the controls for maintaining a constant pick-up broom pattern when the broom is sweeping a street or the like.

Although the best mode contemplated for carrying out the present invention has been herein shown and described, it will be apparent that modification and variation may be made without departing from what is regarded to be the subject matter of the invention.

What is claimed is:

1. An apparatus for maintaining a substantially constant broom pattern on a surface being swept throughout the useful life of a power driven broom journaled on arms movably mounted on the chassis of a mobile sweeper for accommodating vertical movement of said broom, the improvement which comprises:

means defining a shaft having a longitudinal axis journaled on said chassis, linkage means pivotally connecting said shaft to said arms, lever means rigidly secured to said shaft and projecting outwardly from said axis in a first direction, and means defining a spring loaded overcenter linkage having one end pivotally connected to said chassis at a location projecting outwardly from said axis in a second direction and another end pivotally connected to said lever means for applying a progressively decreasing lifting force to the broom as the broom weight decreases due to wear to a point at which the weight of the broom establishes the desired broom path, continued reduction of the weight of the broom due to wear, progressively applying an increasing downward force on the broom until the broom is worn sufficiently to terminate its useful life.

2. An apparatus according to claim 1 wherein said spring loaded overcenter linkage means comprises a spring, and adjustable spring tensioning means at one end of said overcenter linkage for maintaining the desired spring tension.

3. An apparatus according to claim 1 wherein said spring loaded overcenter linkage includes adjustment means on said lever means for adjusting the position of said another end of said linkage relative to the longitudinal axis of said shaft.

4. An apparatus according to claim 3 wherein said lever means comprises an upright wall, and flanges projecting outwardly from said wall, and wherein said adjustment means comprises a spring positioning adjustment bolt rotatably mounted on said flange and held from axial movement relative thereto, and a nut in threaded engagement with said bolt and pivotally attached to said another end of said overcenter linkage.

5. An apparatus according to claim 1 wherein said broom is a pick-up broom and wherein said linkage means includes a first pair of levers rigidly connected to said shaft and a second pair of levers pivotally connected to associated ones of said first pair of levers and said arms.

6. An apparatus according to claim 5 wherein the pick-up broom is approximately 36 inches in diameter when new, and when worn is about 16 inches in diameter when its useful life is terminated.

7. An apparatus according to claim 6 wherein the width of the broom pattern is preferably between about 6–8 inches measured transversely of the axis of the broom.

8. An apparatus according to claim 1 wherein said lever means includes means defining an elongated slot with end portions therein, and additionally comprising a hydraulic cylinder pivotally connected to said chassis, a piston rod in said cylinder, and pin means secured to said piston rod and extending into said slot, said piston rod being extended to engage one end of said slot for pivoting said lever and raising said broom off the ground into transport position, said piston rod being retracted with the pin freely floating in said slot when the broom is sweeping the surface to be cleaned.

* * * * *